United States Patent [19]

Caro

[11] 4,336,651

[45] Jun. 29, 1982

[54] CIRCULAR SAFETY RAZOR

[76] Inventor: Israel Caro, P.O. Box 841, Munoz Rivera 18 St., Rincon, P.R. 00743

[21] Appl. No.: 151,940

[22] Filed: May 21, 1980

[51] Int. Cl.[3] ..... B26B 21/00

[52] U.S. Cl. ..... 30/49

[58] Field of Search ..... 30/49, 50, 77

[56] References Cited

U.S. PATENT DOCUMENTS

| | | | |
|---|---|---|---|
| 2,036,057 | 3/1936 | Kulisek | 30/49 X |
| 2,598,711 | 6/1952 | Musso | 30/49 |
| 2,632,242 | 3/1953 | Musso | 30/49 X |
| 3,465,436 | 9/1969 | Musso | 30/49 |
| 3,702,026 | 11/1972 | Scholin | 30/49 |

FOREIGN PATENT DOCUMENTS

| | | | |
|---|---|---|---|
| 360988 | 11/1931 | United Kingdom | 30/49 |

*Primary Examiner*—James G. Smith
*Attorney, Agent, or Firm*—Donald A. Kettlestrings

[57] ABSTRACT

A circular razor assembly having replaceable annular blades and apparatus for adjusting the positions of the blades whereby the user can control the depth of the cut of hair or beard. Cleaning openings are also associated with the blades to provide for easy cleaning of the razor.

15 Claims, 5 Drawing Figures

CIRCULAR SAFETY RAZOR

This invention relates to safety razors and more particularly to a razor having replaceable annular blades each with an internal cutting edge, and wherein blade guards are easily and quickly adjustable with respect to the blades to control the depth of the cut of hair or beard.

Numerous types of safety razors have been developed, and although such devices have served the purpose, they have not always proved entirely satisfactory under all conditions of service.

It is, therefore, an object of the present invention to provide a circular safety razor which by its design enables the user to maintain his or her hand closer to the skin surface so as to reduce possible vibrations and cuts.

Another object is to provide a safety razor wherein maintenance is reduced to a minimum.

A further object of the invention is the provision of a safety razor which uses two annular blades so as to extend the useful life of each blade.

Still another object is to provide a circular safety razor designed to distribute pressure applied by the user uniformly throughout the area to be shaved.

Yet another object of the present invention is the provision of a circular safety razor wherein the annular blades are adjustable and wherein the cutting edges of the blades can be protected when the razor is not in use.

A still further object of the invention is the provision of a safety razor which is designed to enable easy cleaning.

Another object is to provide a circular safety razor wherein the blades can be easily replaced.

A further object of the invention is the provision of a safety razor which can be safely used to shave fractured hairy parts of the body in preparation for surgical operations.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a razor assembly including a disc-shaped support member defining first and second opposed and substantially planar surfaces with a circumferential surface extending between the first and second surfaces, and an axially positioned aperture extending through the support member between the opposed surfaces; a first annular boss defining inner and outer surfaces and projecting from the first planar surface in cooperating relationship with the first planar surface to define a first interior space; a substantially cylindrically shaped control member defining a centrally located smooth exterior surface and threaded ends, the control member positioned within the aperture with the smooth exterior surface in frictional but movable engagement with the surface of the aperture; a first annular blade having a cutting edge along its inner margin; and first means in operative relationship with the blade, the boss, the support member and with the control member for positioning and enabling adjustment of the position of the blade, whereby the user can control the depth of the cut of the hair or beard.

In accordance with this invention, the razor assembly is symmetrical in configuration, and a second annular boss projects from the second planar surface of the support member. A second annular blade is provided and second means are provided in operative relationship with the second blade, the second boss, the support member and with the control member for positioning and enabling adjustment of the position of the second blade.

It is to be understood that both the foregoing general description and the following detailed description are exemplary and explanatory, but are not restrictive of the invention.

The accompanying drawings, which are incorporated in and constitute a part of this specification, illustrate an example of a preferred embodimemnt of the invention and, together with the description, serve to explain the principles of the invention.

Figure 1:
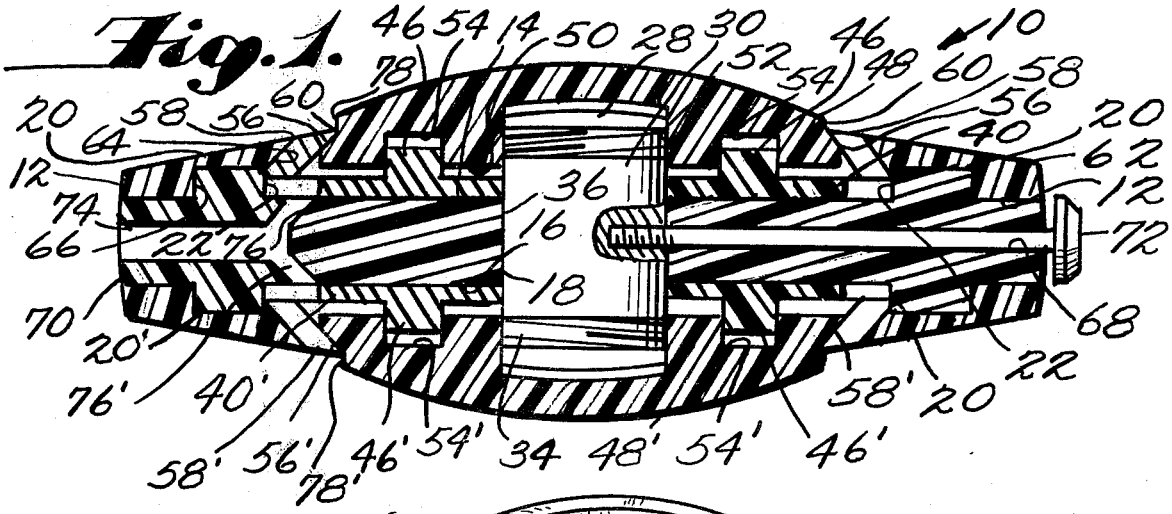
FIG. 1 is a cross sectional view of the razor assembly taken along the line 1—1 in FIG. 2 and looking in the direction of the arrows.
Figure 5:
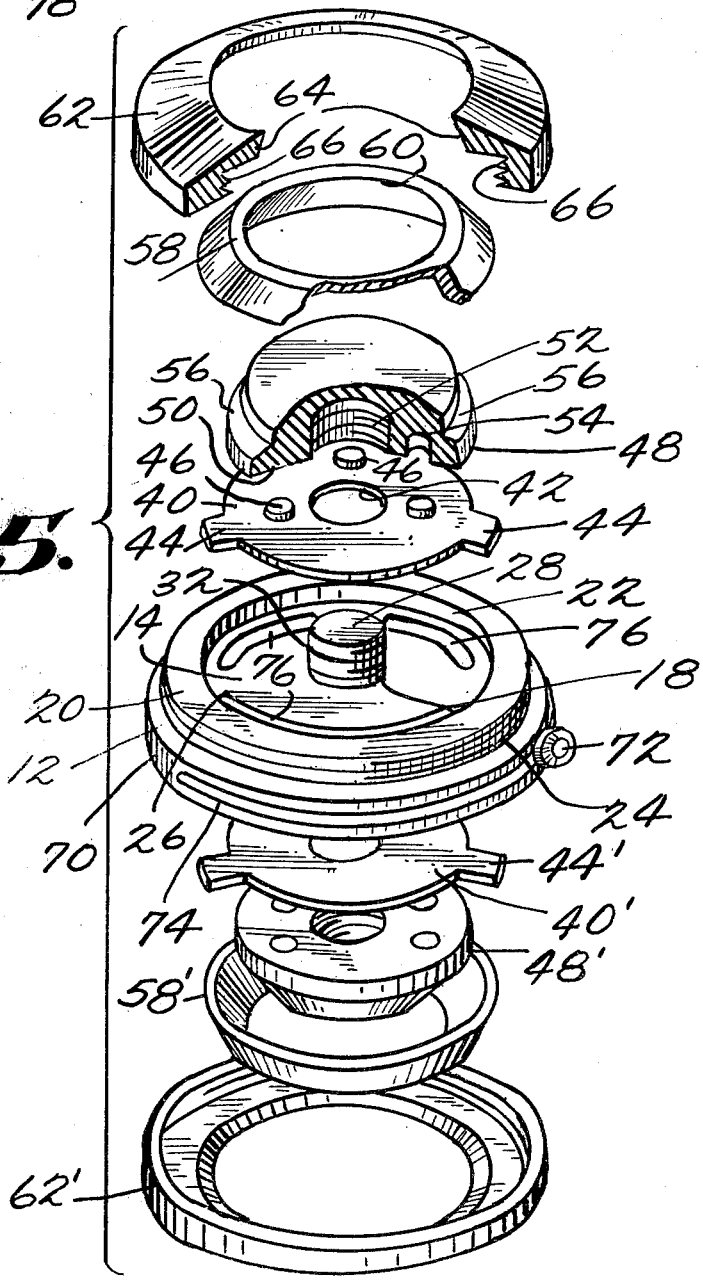
FIG. 5 is an exploded perspective view of the assembly.
Figure 2:
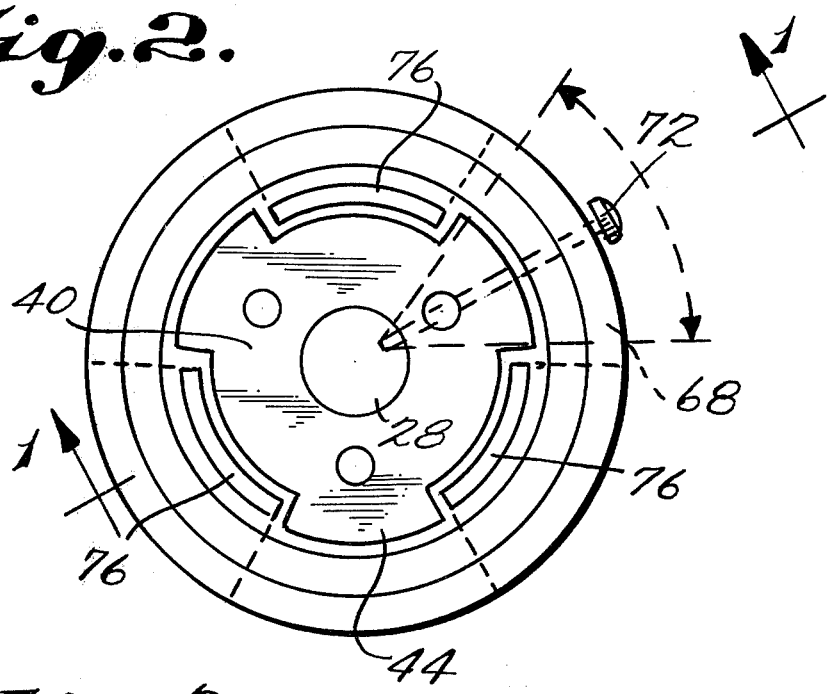
FIG. 2 is a top plane view of the razor assembly with some assembly elements removed for greater illustrative clarity.
Figure 3:
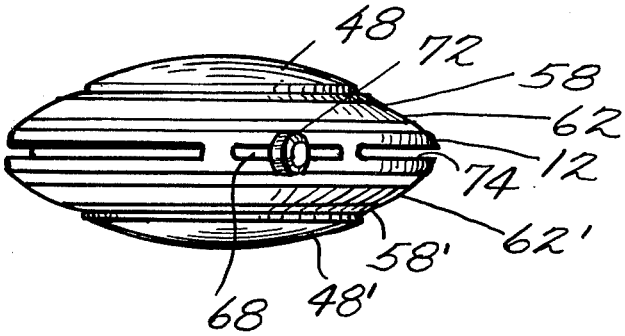
FIG. 3 is an elevational view of the assembly.
Figure 4:
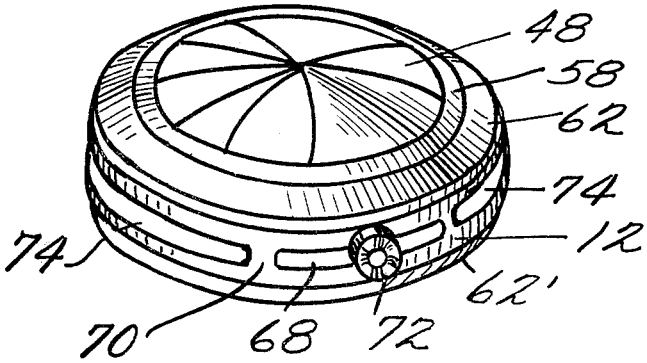
FIG. 4 is a perspective view of the assembly.

With reference now to the drawings, wherein like reference characters designate like or corresponding parts throughout the several views, there is shown a razor assembly 10 having a circular, disc-shaped support member 12 defining first and second opposed and substantially planar surfaces 14, 16. Support member 12 further defines an axially positioned aperture 18 extending through support member 12 between opposed surfaces 14, 16.

A first annular boss 20 defining inner and outer surfaces 22, 24 projects from planar surface 14 and in cooperating relationship therewith to define a first interior space 26.

A substantially cylindrically shaped control member 28 is provided with a centrally located smooth exterior surface 30 and with threaded ends 32, 34. Control member 28 is positioned within aperture 18 with smooth surface 30 in frictional but movable engagement with surface 36 of aperture 18.

A first substantially planar spacer member 40 defines a centrally positioned aperture 42 and a plurality of substantially coplanar lugs 44. Spacer member 40 is positioned on surface 14 within interior space 26. Lugs 44 are located adjacent to inner surface 22 of boss 20 and control member 28 projects through aperture 42. A first plurality of projecting member 46 extend from one side of spacer member 40.

A first substantially convex-shaped guard member 48 defines a base 50 with an axially positioned threaded recess 52 therein for threadably engaging first threaded end 32 of control member 28. Base 50 further defines a plurality of additional unthreaded recesses 54 therein for receiving projecting members 46 of spacer member 40.

Guard member 48 also defines an annular blade seat 56, and a first annular blade 58 having a cutting edge 60 along its inner margin is positioned on lugs 44 when the apparatus is assembled. Outer surface 24 of annular boss 20 is threaded, and an annular retainer member 62 engages blade 58 along contacting surface 64 of the retainer member. A threaded surface 66 is provided on the retainer member and this threaded surface is placed in adjustable threaded relationship with outer threaded surface 24 of boss 20.

Suppprt member 12 defines a wedge-shaped control opening 68 extending between support member aperture 18 and circumferential surface 70. A pin member 72 is removably attached to control number 28 at 29, such as by screw threaded arrangement, and the pin member extends through control opening 68 and beyond circumferential surface 70 for enabling grasping of the pin member by a user whereby the pin member can be moved laterally within control opening 68.

An important feature of this invention is the provision of easy cleaning of the razor assembly. In order to provide this easy cleaning feature, support member 12 defines a plurality of first cleaning openings 74 in circumferential surface 70, and a plurality of additional cleaning openings 76 are located in surface 14 and in respective fluid communication with cleaning openings 74.

The razor assembly 10 of this invention is symmetrical about support member 12. Consequently, elements 40, 48, 58 and 62 and their associated sub-elements have corresponding elements 40', 48', 58' and 62' located on the opposite side of support member 12, as illustrated in the figures. Movement of pin member 72 simultaneously controls movement of elements on both sides of support member 12.

Blades 58, 58' can be easily replaced by removing retainer members 62, 62' from bosses 20, 20', respectively. The old blades can then be lifted out and replacement blades are then inserted into position onto lugs 44, 44' of spacer members 40, 40', and retainer member 62, 62' are then threaded back onto bosses 20, 20' until contacting surfaces 64, 64' of the retainer members are positioned against blades 58, 58', respectively. Of course, either blade can be replaced without requiring replacement of the other blade.

When the razor is assembled, the force exerted by surface 64 of retainer member 62 against blade 58 causes the blade to exert force against lugs 44 of spacer member 40. This causes spacer member 40 to be held in a fixed position and guard member 48 is also held in a fixed position by means of projecting members 46 extending into unthreaded recesses 54 of the guard member. Thus, guard member 48 is held in a fixed position with respect to the assembly during use of the razor and rotational movements of guard member 48 within the assembly are prevented when the guard member makes contact with the skin surface during the shaving operation.

Adjustment of the positions of blades 58, 58' is simultaneously accomplished by lateral movement of pin member 72 within wedge-shaped control opening 68. Such movement of the pin member causes rotational movement of control member 28 within aperture 18. This, in turn, causes guard member 48, 48' to move outwardly or inwardly with respect to support member 12, depending upon which way the pin member is moved. For example, movement of pin member 72 in a first lateral direction within control opening 68 causes guard member 48, 48' to move inwardly with respect to support member 12 or toward each other. Conversely, movement of pin member 72 in an opposite lateral direction within control opening 68 causes guard members 48, 48' to move outwardly with respect to the support member or away from each other. This adjustment of the positions of guard members 48, 48' enables the guard members to be moved to a position with blades 58, 58' resting on blade seats 56, 56'. This is a preferred position when the razor assembly is not in use. Cutting edges 60, 60' of the blades are then protected by means of surfaces 78, 78' which form integral parts of guard members 48, 48'.

Retracting movement of guard members 48, 48' with respect to the cutting edges of blades 58, 58' to expose the cutting edges for use is accomplished by moving pin member 72 in a predetermined direction within control opening 68. This movement will result in guard members 48, 48' moving toward each other, and cutting edges 60, 60' of the blades will be exposed above surfaces 78, 78' of the guard members. The depth of the cut of hair or beard can be easily controlled by lateral movement of pin member 72 within control opening 68 so that the positions of cutting edges 60, 60' of the blades is adjusted with respect to surfaces 78, 78' of the guard members.

Another important feature of this invention is the provision for continuous removal of hair or beard pieces from the razor during use, and more particularly, for removal of the hair or beard pieces from the area immediately adjacent to the cutting edges of the blades. This feature prevents the hair or beard particles from interfering with the shaving operation, and is provided by means of cleaning openings 76, 76' within support member 12. The dimensions of spacer members 40, 40' and of guard members 48, 48' are such that openings 76, 76' are exposed to and are in fluid communication with cutting edges 60, 60' of the blades. In addition, cleaning openings 74 are in fluid communication with opening 76, 76'. Thus, the severed hair or beard particles naturally flow from the area adjacent to cutting edges 60, 60' through openings 76, 76' and ultimately, out through openings 74. This flow of beard or hair particles away from cutting edges 60, 60' occurs naturally during the shaving operation, but additional cleaning can be simply accomplished by flushing water through openings 74 and 76, 76'. Such flushing is recommended after each use to ensure that the razor is kept clean.

Blades 58, 58' are preferably made from stainless steel or chromium, with stainless steel preferred. The blades can be made, for example, by using a grinding wheel or a very fine or smooth abrasive covered surface having a size and shape corresponding to that part of the blades to ensure sharp and perfect cutting edges.

Pin member 72 may be made by an injection molding process using a plastic substance that can be put into a mold while in a soft or plastic condition and then allowed to harden. Nylon is one example of a plastic substance that could be used in the formation of pin member 72. Any other suitable plastic material could also be used.

This invention provides a symmetrical, circular, safety razor that provides the user with a greater amount of control during the shaving operation to reduce possible vibrations of the razor and to prevent cuts. The annular blade provides a large cutting edge and the symmetrical construction of the razor enables both sides to be used for the shaving operation. This results in further extended life for the blades. The convex shape of guard members 48, 48' provides an important advantage since pressure applied by the user to the razor assembly is distributed uniformly throughout the area to be shaved by means of the convex-shaped guard members. Contrary to conventional razor arrangements, the razor assembly of this invention does not transmit force directly from the user to the blade cutting edge. Rather, the force applied by the user is transmitted to the area to be shaved by means of the convex-shaped guard members 48, 48'. This results in greater safety and control.

Razor assembly 10 is also provided with the important feature of enabling both blades to be retracted simultaneously into protected positions when the razor is not being used. Adjustment of the positions of the blades with respect to guard members 48, 48' is also provided so that control of the depth of the cut of the hair or beard is easily provided.

The razor assembly can also be easily cleaned and maintained and it is particularly useful in surgical operations involving fractured hairy parts of the body. The even distribution of forces provided by the razor assembly enables the instrument to be used with minimum risk in such situations. Of course, the assembly of this invention can be used by either men or women with equally successful results.

The invention in its broader aspects is not limited to the specific details shown and described and departures may be made from such details without departing from the principles of the invention and without sacrificing its chief advantages.

What is claimed is:

1. A razor assembly comprising:

a disc-shaped support member defining first and second opposed and substantially planar surfaces and a circumferential surface extending between said first and second surfaces, and an axially positioned aperture extending through said member between said opposed surfaces;

a first annular boss defining inner and outer surfaces and projecting from said first planar surface in cooperating relationship with said first planar surface to define a first interior space;

a substantially cylindrically shaped control member defining a centrally located smooth exterior surface and a threaded end, said control member positioned within said aperture with said smooth exterior surface in frictional but movable engagement with the surface of said aperture;

a first annular blade having a cutting edge along its inner margin;

first means in operative relationship with said blade, said boss, said support member and with said control member for positioning and enabling adjustment of the position of said blade to control the depth of the cut of the hair or beard;

said first means including a first substantially planar spacer member defining a centrally positioned aperture and a plurality of substantially coplanar lugs, said spacer member positioned on said first planar surface within said first interior space with said lugs adjacent to said inner surface of said annular boss and with said control member projecting through said spacer member aperture, and a first plurality of projecting members extending from one side of said spacer member.

2. An assembly as in claim 1 wherein said first means further include:

a first substantially convex-shaped guard member defining a base with an axially positioned threaded recess therein for threadably engaging a first threaded end of said control member, with a plurality of additional unthreaded recesses therein for receiving said projecting members, and an annular blade seat;

said annular blade positioned on said lugs;

said boss defining threads on said outer surface thereof; and an annular retainer member engaging said blade and defining a threaded surface in adjustable threaded relationship with said boss outer threaded surface.

3. An assembly as in claim 2 wherein said support member further defines a control opening extending between said support member aperture and said circumferential surface of said support member, and wherein said first means further include a pin member removably attached to said control member and extending through said control opening and beyond said circumferential surface for enabling grasping of said pin member by a user.

4. An assembly as in claim 3 wherein said support member further defines a plurality of first cleaning openings in said circumferential surface and a plurality of additional cleaning openings in said first surface in fluid communication with said first cleaning openings in said circumferential surface.

5. An assembly as in claim 4 wherein said lugs are positioned between said additional cleaning openings.

6. An assembly as in claim 5 wherein said control member defines a second threaded end and further including:

a second annular boss defining inner and outer surfaces and projecting from said second planar surface in cooperating relationship with said second planar surface to define a second interior space;

a second annular blade having a cutting edge along its inner margin; and second means in operative relationship with said second boss, said support member, said second blade and with said control member for positioning and enabling adjustment of the position of said second blade whereby the user can control the depth of the cut of the hair or beard.

7. An assembly as in claim 6 wherein said second means include:

a second substantially planar spacer member defining a centrally positioned aperture and a second plurality of substantially coplanar lugs, said second spacer member positioned on said second planar surface within said second interior space with said second plurality of lugs adjacent to said inner surface of said second boss and with said control member projecting through said second spacer member aperture; and a second plurality of projecting members extending from one side of said second spacer member.

8. An assembly as in claim 7 wherein said second means further include:

a second substantially convex-shaped guard member defining a base with an axially positioned threaded recess therein for threadably engaging a second threaded end of said control member, with a second plurality of additional unthreaded recesses therein for receiving said second plurality of projecting members and a second annular blade seat;

said second annular blade positioned on said second plurality of lugs;

said second boss defining threads on said outer surface of said second boss; and a second annular retainer member engaging said second blade and defining a second threaded surface in adjustable threaded relationship with said second boss outer threaded surface.

9. An assembly as in claim 8 wherein said second means further include said pin member.

10. An assembly as in claim 9 wherein said support member further defines a second plurality of additional cleaning openings in said second surface in fluid communication with said first cleaning opening in said circumferential surface.

11. An assembly as in claim 10 wherein said second plurality of lugs are positioned between said second plurality of additional cleaning openings.

12. An assembly as in claim 11 wherein said threads on said theaded ends of said control member and said threads in said threaded recesses of said first and second guard members are such that movement of said pin member in a first direction simultaneously causes said first and second guard members to move farther apart with respect to each other and wherein movement of said pin member in a second direction simultaneously causes said guard member to move closer together.

13. An assembly as in claim 12 wherein said control opening is wedge-shaped.

14. An assembly as in claim 13 wherein said blades are made from stainless steel.

15. An assembly as in claim 13 wherein said blades are made from chromium.

* * * * *